US007713091B2

(12) United States Patent
Chen

(10) Patent No.: US 7,713,091 B2
(45) Date of Patent: May 11, 2010

(54) ADAPTOR DEVICE FOR CONNECTING AND ACCESSING DATA CARD AND COMPUTER DEVICE INCORPORATING THE ADAPTOR DEVICE

(75) Inventor: Yen-Wei Chen, Keelung (TW)

(73) Assignee: Getac Technology Corp., Hsin-Chu Hsien (TW)

( * ) Notice: Subject to any disclaimer, the term of this patent is extended or adjusted under 35 U.S.C. 154(b) by 70 days.

(21) Appl. No.: 12/232,191

(22) Filed: Sep. 12, 2008

(65) Prior Publication Data

US 2010/0068937 A1 Mar. 18, 2010

(51) Int. Cl.
*H01R 24/00* (2006.01)

(52) U.S. Cl. ..... 439/630; 439/924.1

(58) Field of Classification Search ..... 439/630, 439/541.5, 924.1
See application file for complete search history.

(56) References Cited

U.S. PATENT DOCUMENTS 5,563,400 A * 10/1996 Le Roux ..... 235/486
5,603,629 A * 2/1997 DeFrasne et al. ..... 439/331
5,752,857 A * 5/1998 Knights ..... 439/638
5,877,488 A * 3/1999 Klatt et al. ..... 235/486
5,933,328 A * 8/1999 Wallace et al. ..... 361/737
6,106,317 A * 8/2000 Michaelis et al. ..... 439/326
6,173,405 B1 * 1/2001 Nagel ..... 726/21
6,213,403 B1 * 4/2001 Bates, III ..... 235/492
6,241,545 B1 * 6/2001 Bricaud et al. ..... 439/326
6,592,031 B1 * 7/2003 Klatt ..... 235/382
6,761,320 B1 * 7/2004 Chen ..... 235/492
7,029,306 B2 * 4/2006 Bilcauu et al. ..... 439/326
7,233,489 B2 * 6/2007 Toyama et al. ..... 361/679.31
7,300,314 B2 * 11/2007 Kim ..... 439/630
7,364,468 B2 * 4/2008 Liu et al. ..... 439/638
7,385,827 B2 * 6/2008 Klatt ..... 361/737

* cited by examiner

*Primary Examiner*—T C Patel
*Assistant Examiner*—Harshad C Patel
(74) *Attorney, Agent, or Firm*—Rosenberg, Klein & Lee

(57) ABSTRACT

An adaptor device is provided for connecting and accessing data cards of various specifications and includes a data card insertion structure, a cover board, and a carrier board. The data card insertion structure forms at least one first insertion slot for the insertion of the carrier board. The carrier board forms at least one data card carrying section for carrying at least one selected data card. The cover board is mounted to a top surface of the data card insertion structure. An underside of the cover board is provided, at a predetermined position, with at least one set of signal contact elements. When the carrier board is inserted in the first insertion slot, a signal contact section of the data card is electrically connectable with the signal contact elements of the cover board for direct output through a signal connection port of the cover board or for output to a computer device via a signal connection port of the data card insertion structure.

15 Claims, 13 Drawing Sheets

ADAPTOR DEVICE FOR CONNECTING AND ACCESSING DATA CARD AND COMPUTER DEVICE INCORPORATING THE ADAPTOR DEVICE

FIELD OF THE INVENTION

The present invention relates to an adaptor device, and in particular to an adaptor device that is used in a computer device for connecting and accessing various data cards.

BACKGROUND OF THE INVENTION

PCMCIA (Personal Computer Memory Card International Association) is an international standard that defines and promotes PC Card (formerly known as "PCMCIA card"). PCMCIA interfaces are commonly used in regular desktop computers or notebook computers to serve as a data card reading device. The PCMCIA interfaces have very broad applications and are commonly used with an adaptor interface device to read data cards or memory cards of various specifications or to serve as an externally connected wireless networking card or a transmission interface for other external devices.

FIG. 1 of the attached drawings shows a conventional dual-slot computer card adaptor device. As shown, a notebook computer 100 is provided, at a side wall thereof, with an adaptor device 1 that meets PCMCIA specifications. The adaptor device 1 comprises a data card insertion structure 10, which is of a dual-slot configuration, including a first insertion slot 11 having an associated first ejection button 110 and a second insertion slot 12 having an associated ejection button 120. The first insertion slot 11 and the second insertion slot 12 are each for the insertion of a computer card 13 for accessing and supplying the data of the computer card 13 to the notebook computer 100.

In respect of known techniques that use a PCMCIA interface to read data cards of various formats, Taiwan Utility Model M246731 discloses a seven-in-one PCMCIA interface, wherein a connection circuit is provided in a cartridge that mates a slot of the PCMCIA interface. A front end of the cartridge is provided with a connector for the insertion of a memory card of one of the following seven specifications: CF, MD, MMC, MS, SD, SM and XD and for access, exchange, and transmission of data of the various memory cards via the connection circuit. Thus, an electric/electronic appliance that is provided with a PCMCIA interface is allowed to read/write a memory card of at least the previously mentioned seven specifications.

SUMMARY OF THE INVENTION

However, in the known technology of the data card adaptor device, adapting and accessing a data card in a one-to-one fashion is generally based on an originally existing PCMCIA interface, together with an external cartridge-like adaptor device, to realize access of data cards of various specifications. With the rapid progress and development of the modern information technology, the innovation and development of new specifications for data cards are so fast and frequent that the one-to-one architecture for data card adaptation is of an unacceptable efficiency of use.

For a one-to-multiple data card adaptor device, as shown in the previously mentioned applications, to be used in a dual-slot computer card adaptor device, since the external cartridge-like adaptor device is connected to a data card reading device via a PCMCIA insertion card, when the data card reading device is of a bulky size, the use of the other insertion slot of the dual-slot adaptor device is often interfered with, making it impossible to use the other slot, whereby the design spirit of two individually usable slots is all in vain.

Thus, an objective of the present invention is to provide an adaptor device that is capable to access data cards of various specifications, wherein a carrier board and a cover board can be made to mate with various desired specifications for simultaneous access of data cards of the various specifications.

Another objective of the present invention is to provide an adaptor device that has a design for saving the required amount of space of occupation so that the use of the adaptor device in a dual-slot computer card adaptor device does not interfere with the use of the other slot, allowing full exploitation of the dual-slot computer card adaptor device.

The solution that the present invention adopts to overcome the problems of the prior art technology is to provide a data card insertion structure that meets PCMCIA specifications and that forms a first insertion slot and a second insertion slot. A cover board is mounted to a top surface of the data card insertion structure. The cover board has at least one signal contact element arranged at a predetermined position on the underside of the cover board. A carrier board having a data card carrying section is also provided for receiving and carrying a data card. The carrier board carrying the data card is insertable into the first insertion slot of the data card insertion structure to have the signal contact element of the cover board corresponding and engaging a signal contact section of the data card, such as a chip of a chip card. The data of the data card is accessible via the signal contact element of the cover board and is output through a signal connection port of the cover board, or is alternatively supplied to a computer device sequentially via a signal transfer port that is in connection with the data card insertion structure and a signal connection port of the data card insertion structure.

In view of the above description, the solution of the present invention allows for simultaneous access of data cards of various specifications. Thus, purchasing several one-to-one data card adaptor devices is not necessary and investment can be reduced. Further, the trouble that adaptor devices of different specifications must be interchanged when different data cards are used, and thus, operation efficiency of the data card adaptor device can be improved and time is saved.

Based on the solution of the present invention, together with a dual-slot computer card adaptor device, the use of the adaptor device does not interfere with the use of other slot, so that simultaneous use of the two slots of the dual-slot computer card adaptor device is ensured for carrying out different operations. For example, when transmission is carried out with a data card, a wireless network card of PCMCIA specification can be used in the other slot to effect simultaneous computer data transmission and network surfing. As such, the practicability of the adaptor device is remarkably improved.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
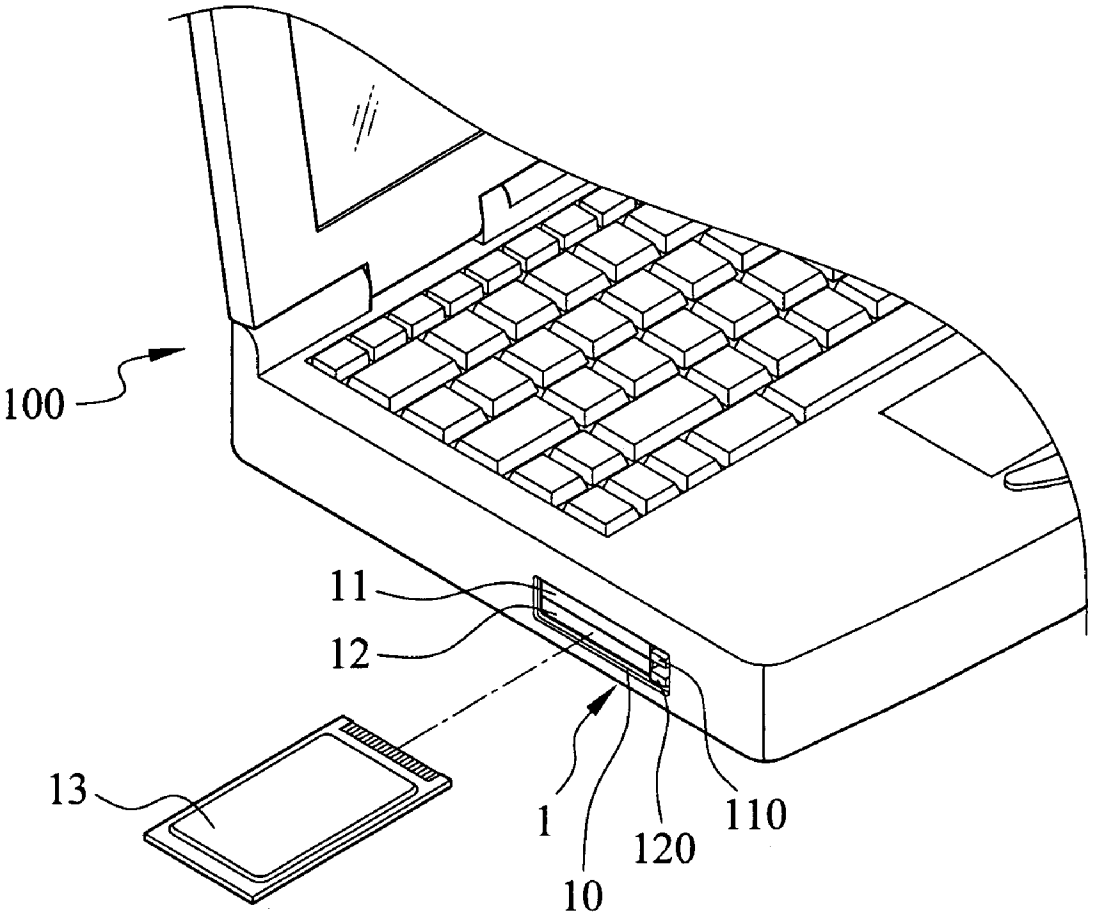
FIG.1(Prior Art)
FIG. 1 shows a conventional computer card adaptor device featuring dual slots.
Figure 2:
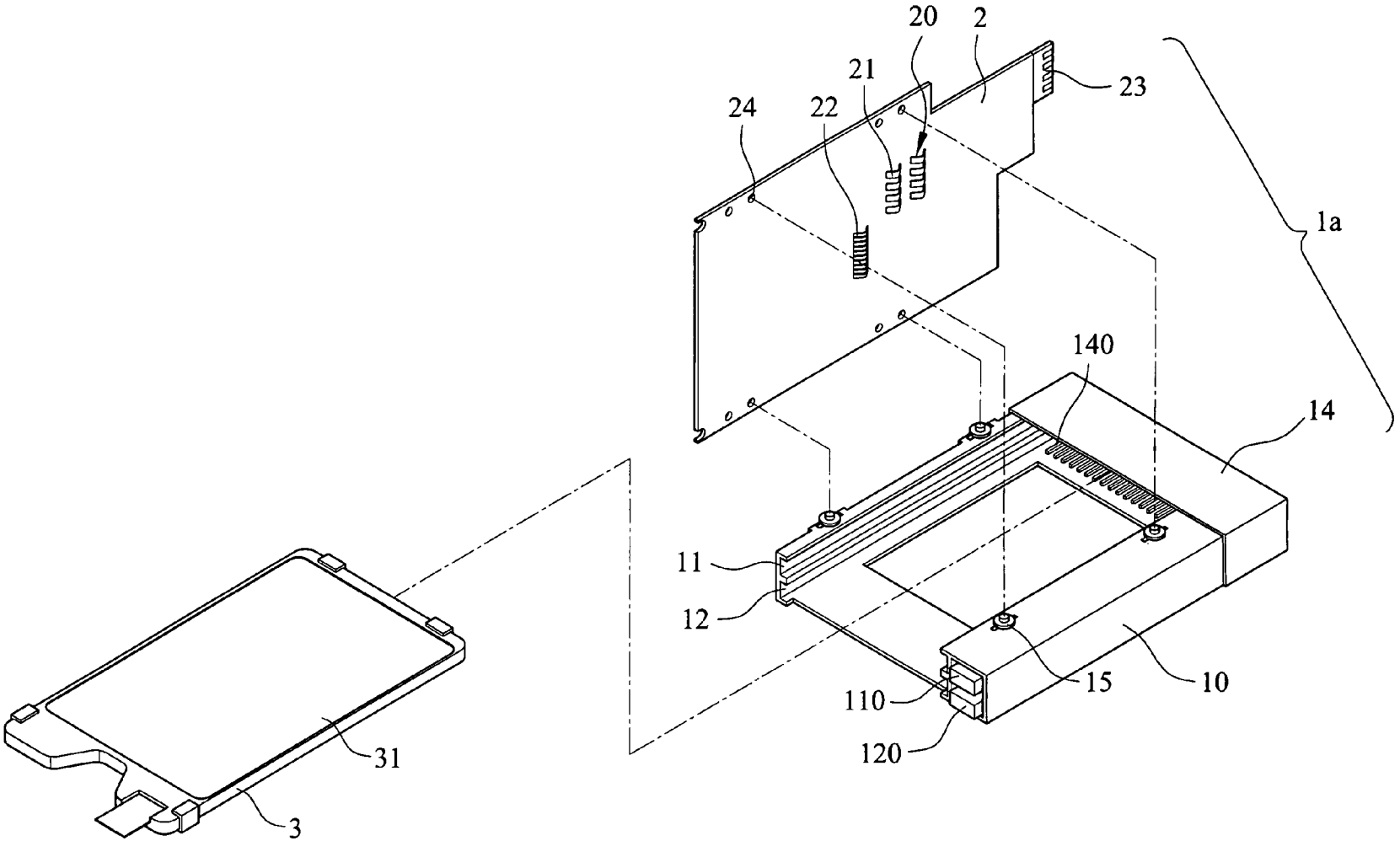
FIG. 2 is an exploded view showing an adaptor device constructed in accordance with a first embodiment of the present invention.
Figure 3:
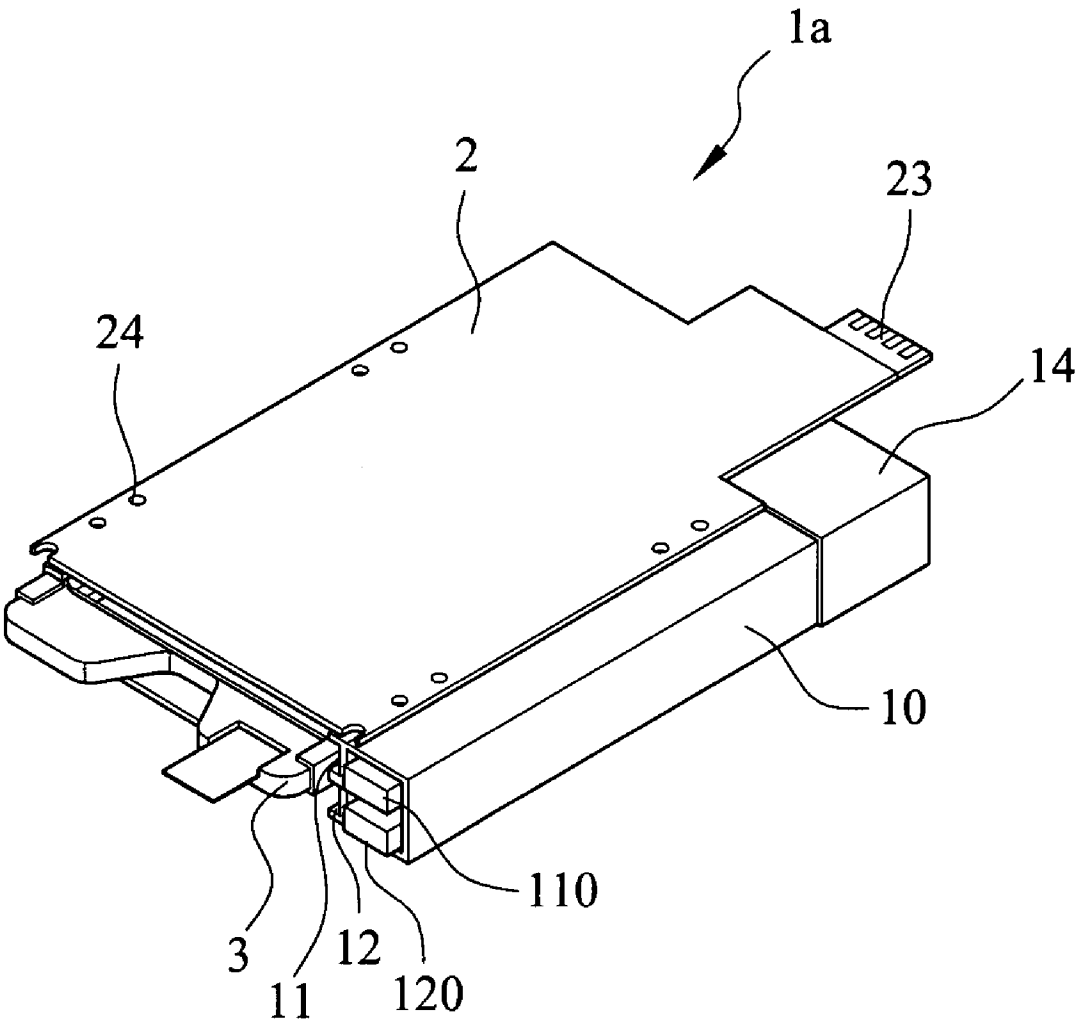
FIG. 3 is a perspective view showing the adaptor device in accordance with the first embodiment of the present invention.

With reference to the drawings and in particular to FIGS. 2 and 3, which respectively show an exploded view and a perspective view of an adaptor device constructed in accordance with a first embodiment of the present invention, generally designated with reference numeral 1*a*, which is provided for connecting and accessing a data card, the adaptor device 1*a* comprises a data card insertion structure 10, a cover board 2, and a carrier board 3 and is connectable with a computer device, such as a notebook computer or a desktop computer to serve as an interface for accessing the data card.

The data card insertion structure 10 comprises a first insertion slot 11 and a second insertion slot 12. The second insertion slot 12 is located below the first insertion slot 11. Both the first insertion slot 11 and the second insertion slot 12 meet the specifications of PCMCIA to allow insertion of computer cards of the specifications. The data card insertion structure 10 has an end forming a connection base 14 having upper and lower sets of pins 140 corresponding in position to the first insertion slot 11 and the second insertion slot 12. Also referring to FIG. 8, the data card insertion structure 10 further comprises a signal connection port 141 for output of a signal read by the pins 140. Formed on opposite edge portions of the data card insertion structure 10 are mounting projections 15 for mounting the cover board 2.

The cover board 2 corresponds to and is mounted to a surface of the first insertion slot 11 and comprises at least one set of signal contact elements 20, which in the embodiment illustrated, includes a set of first signal contact elements 21 and a set of second signal contact elements 22, respectively arranged on predetermined positions on the cover board 2 and adjacent to the first insertion slot 11. The cover board 2 further comprises a signal connection port 23 and also forms a plurality of mounting holes 24. The signal connection port 23 is arranged at one end of the cover board 2 for output of signals accessed by the first signal contact elements 21 and the second signal contact elements 22. The locations of the mounting holes 24 correspond to the mounting projections 15 of the data card insertion structure 10 for fixing the cover board 2 and data card insertion structure 10 together.

The carrier board 3 has a size in accordance with the PCMCIA specifications and is insertable into the first insertion slot 11 or the second insertion slot 12 of the data card insertion structure 10. The carrier board 3 forms a data card carrying section 31 to carry a selected data card so as to fix the data card on a selected position on the carrier board 3.

Figure 4:
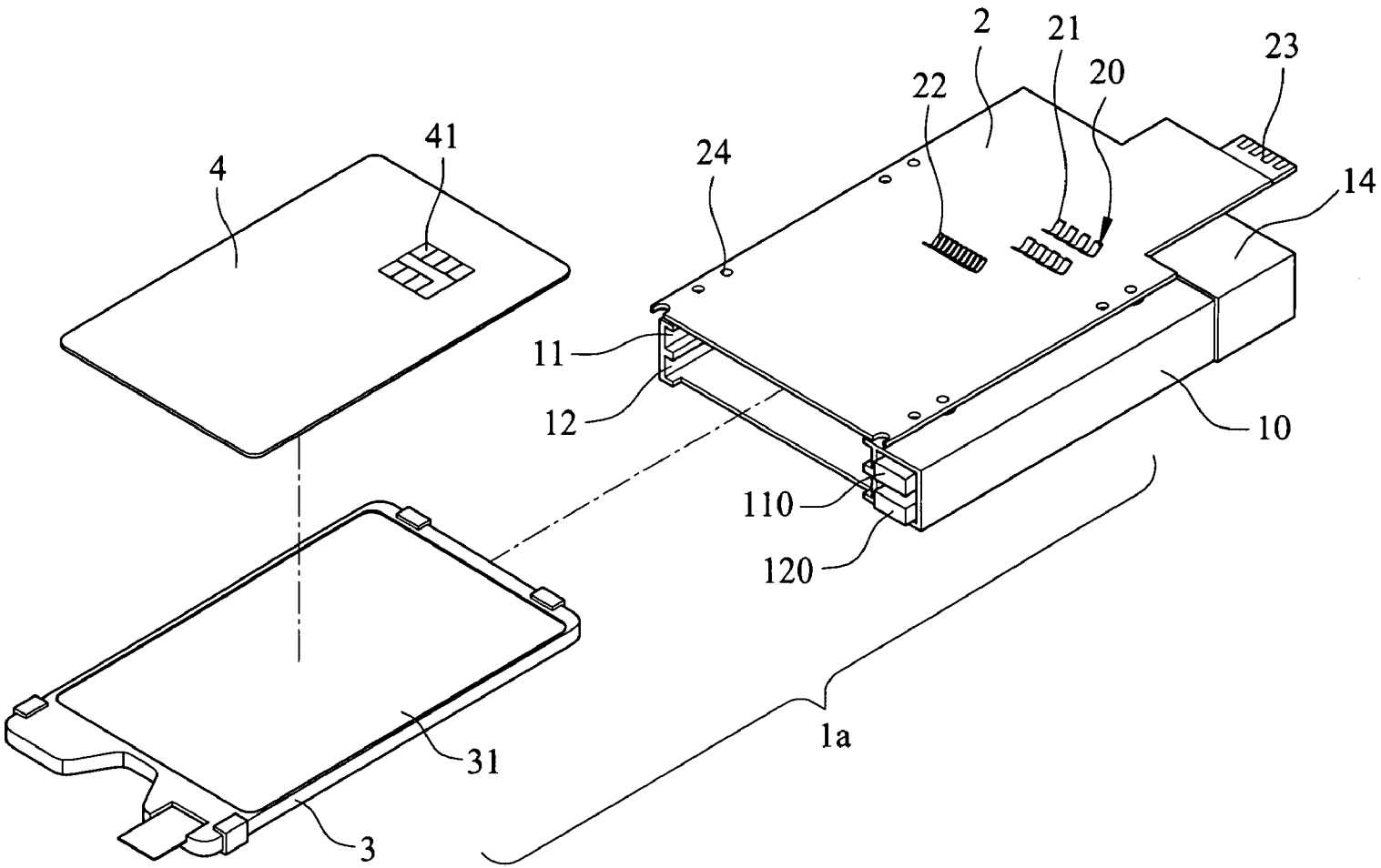
FIG. 4 is a perspective view illustrating an application of the adaptor device of the first embodiment of the present invention to a chip card.
Figure 5:
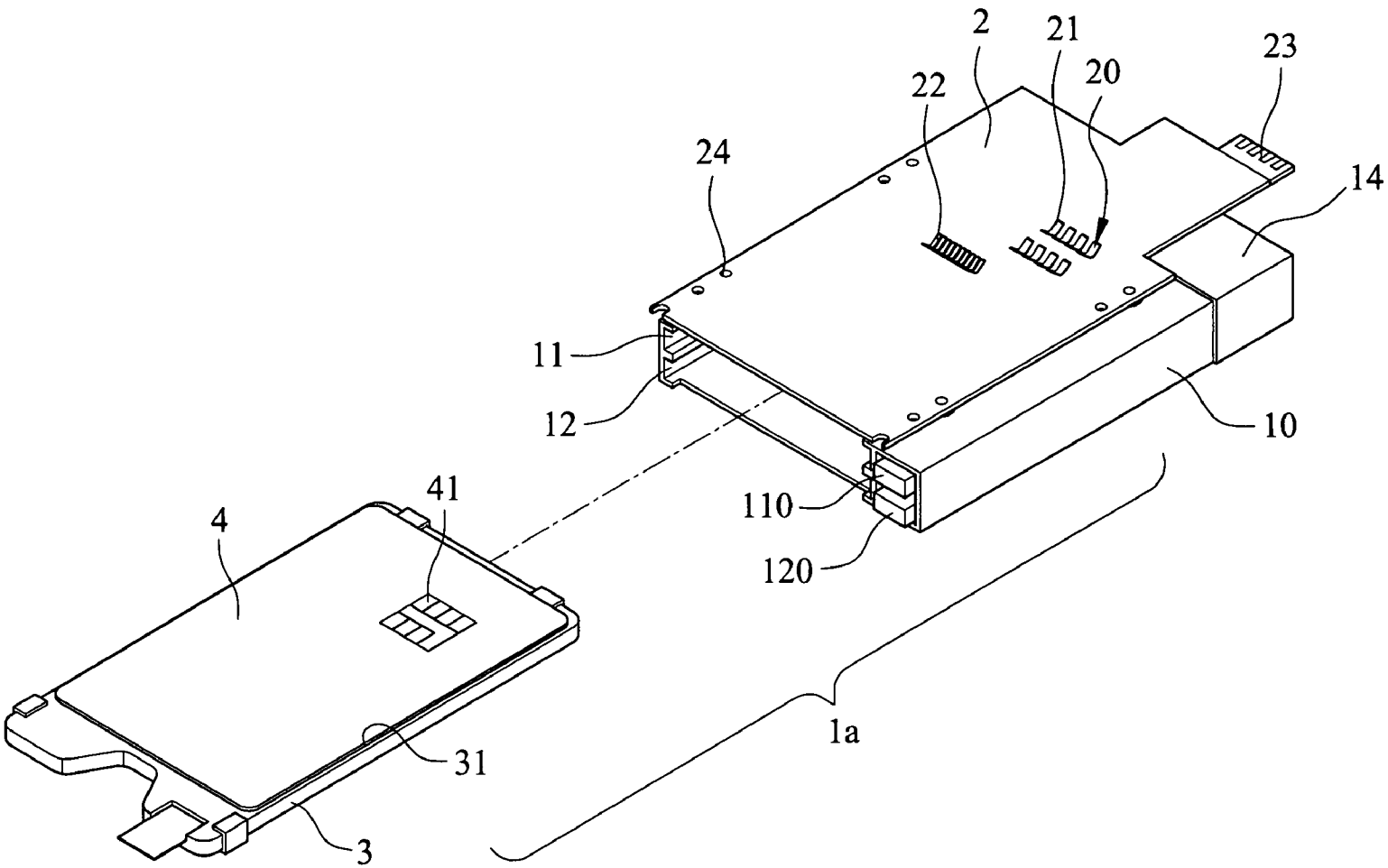
FIG. 5 is a perspective view demonstrating a chip card carried on a carrier board of the adaptor device of the present invention.

Also referring to FIGS. 4 and 5, which are respectively a perspective view illustrating an application of the adaptor device of the first embodiment of the present invention to a chip card and a perspective view demonstrating the chip card carried on the carrier board, in the instant embodiment, the data card carrying section 31 of the carrier board 3 is of a configuration for carrying a chip card 4 so as to have the chip card 4 positioned on the carrier board 3' with a signal contact section 41 of the chip card 4 exposed.

Figure 6:
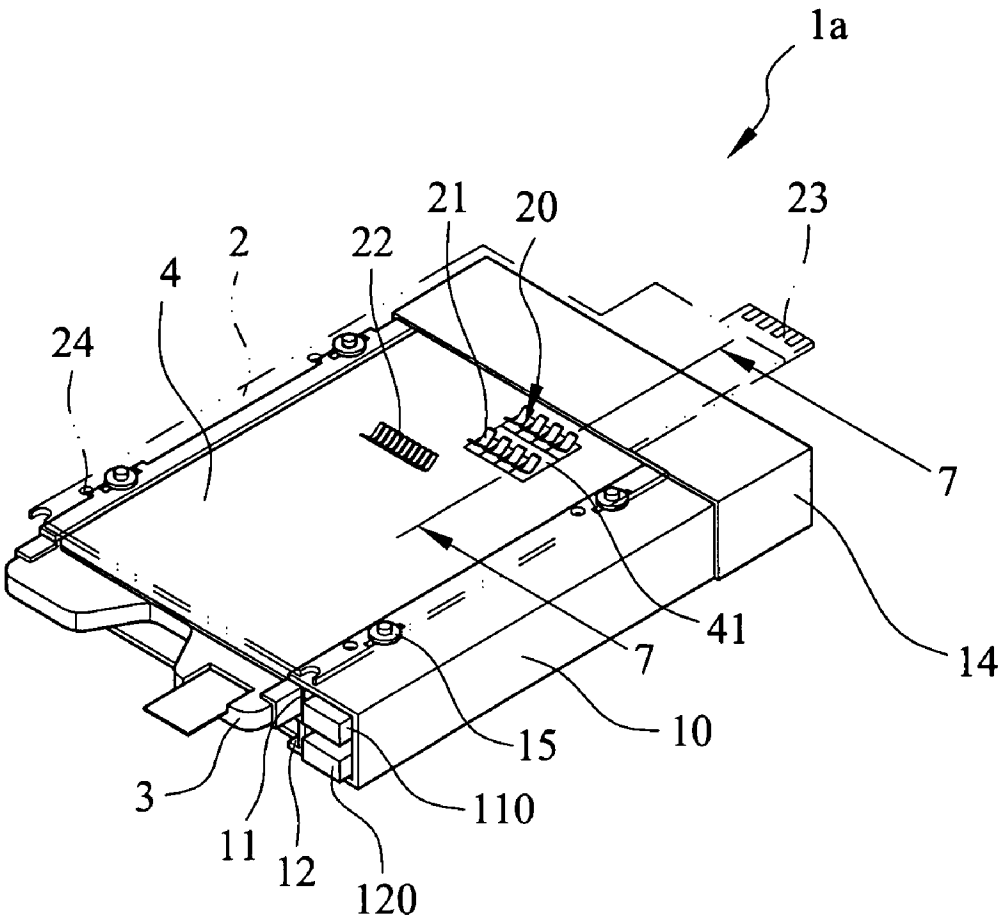
FIG. 6 is a perspective view illustrating the carrier board of FIG. 5 inserted into a data card insertion structure of the adaptor device of the present invention.

Also referring to FIG. 6, which shows a perspective view illustrating the carrier board of FIG. 5 inserted into the data card insertion structure, the chip card 4 is first positioned in the data card carrying section 31 of the carrier board 3 and then inserted into the first insertion slot 11 of the data card insertion structure 10.

Figure 7:
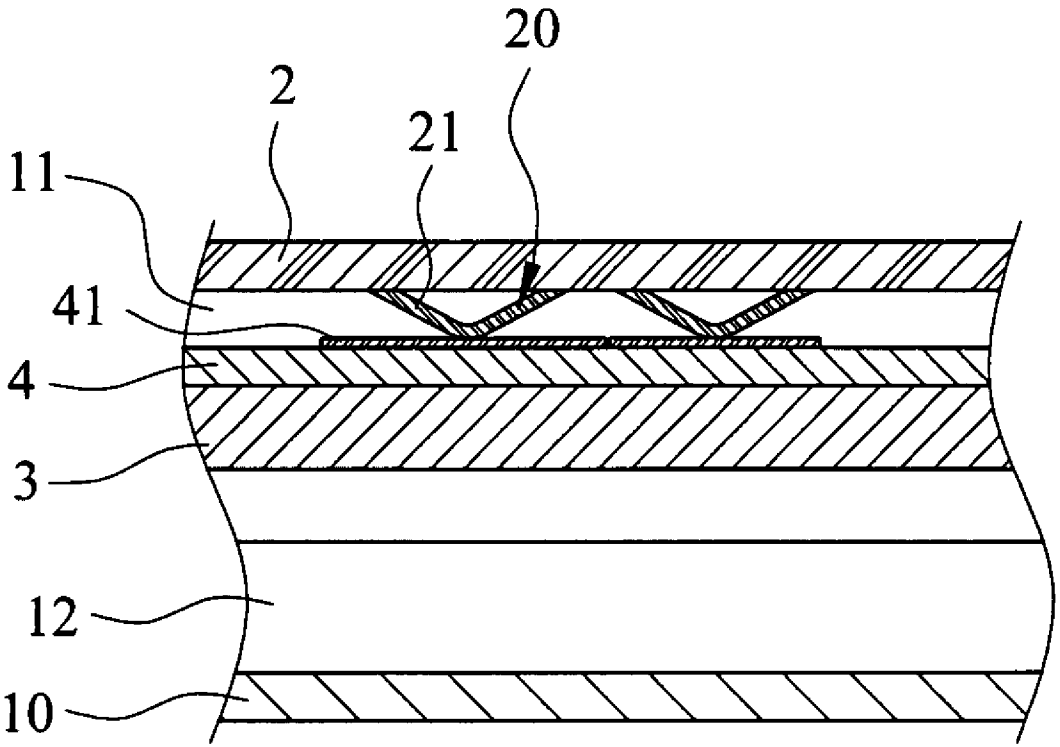
FIG. 7 is a cross-sectional view taken along line 7-7 of FIG. 6.

Also referring to FIG. 7, which is a cross-sectional view taken along line 7-7 of FIG. 6, with the carrier board 3 inserted into the first insertion slot 11 of the data card insertion structure 10, the signal contact section 41 of the chip card 4 is set at a location corresponding to and engaging with the first signal contact elements 21 of the cover board 2 so that data stored in the chip card 4 can be read through the first signal contact elements 21.

Figure 8:
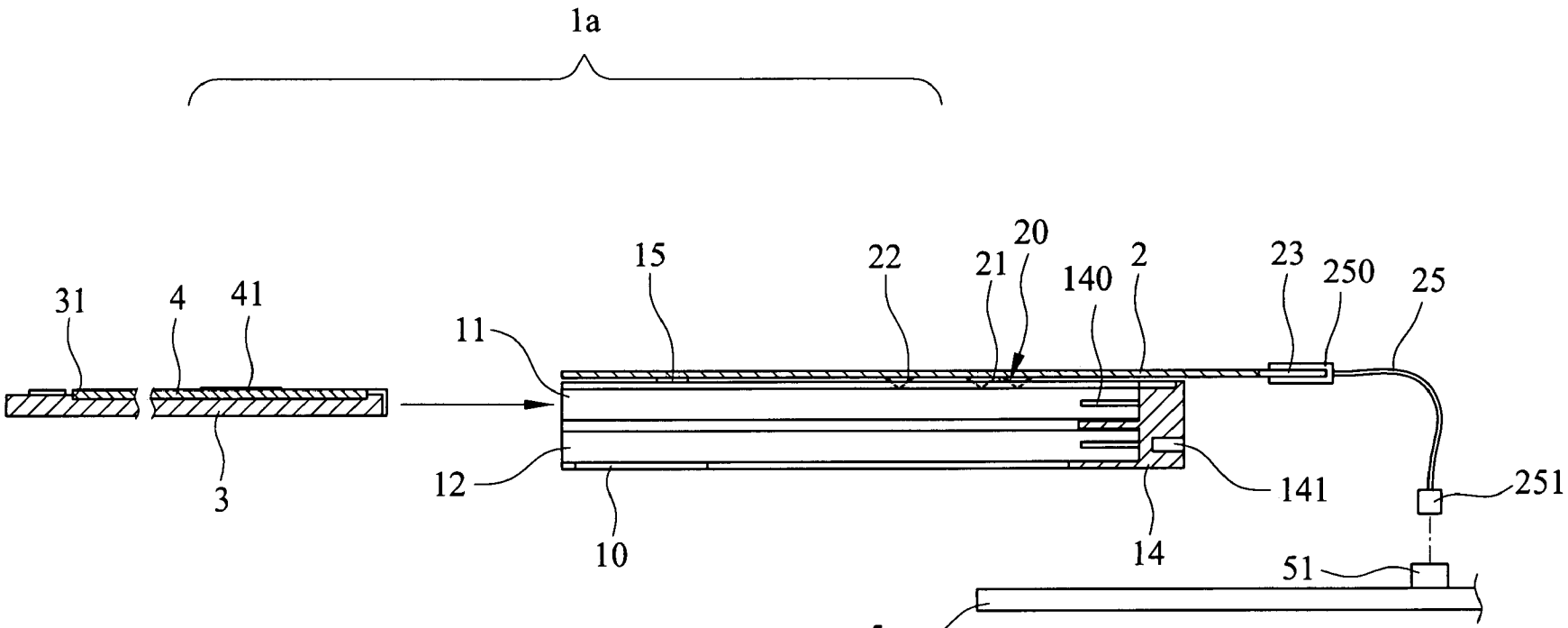
FIG. 8 is a cross-sectional view illustrating the adaptor device of the first embodiment of the present invention connected to a computer main board.

Also referring to FIG. 8, which is a cross-sectional view illustrating the adaptor device of the first embodiment of the present invention connected to a computer main board, which is generally designated at 5, included in a computer device, the signal connection port 23 of the cover board 2 is connected, via a connection flat cable 25, to the computer main board 5 of the computer device. The connection flat cable 25 has opposite ends respectively forming a first plug connector 250 and a second plug connector 251. The first plug connector 250 is connected to the signal connection port 23 of the cover board 2, while the second plug connector 251 is connected to a socket connector 51 of the computer main board 5, whereby the data of the chip card 4 can be supplied to the computer main board 5 via the signal connection port 23 of the cover board 2 to allow the computer device to access the data of the chip card 4 via the signal connection port 23 of the cover board 2.

Figure 9:
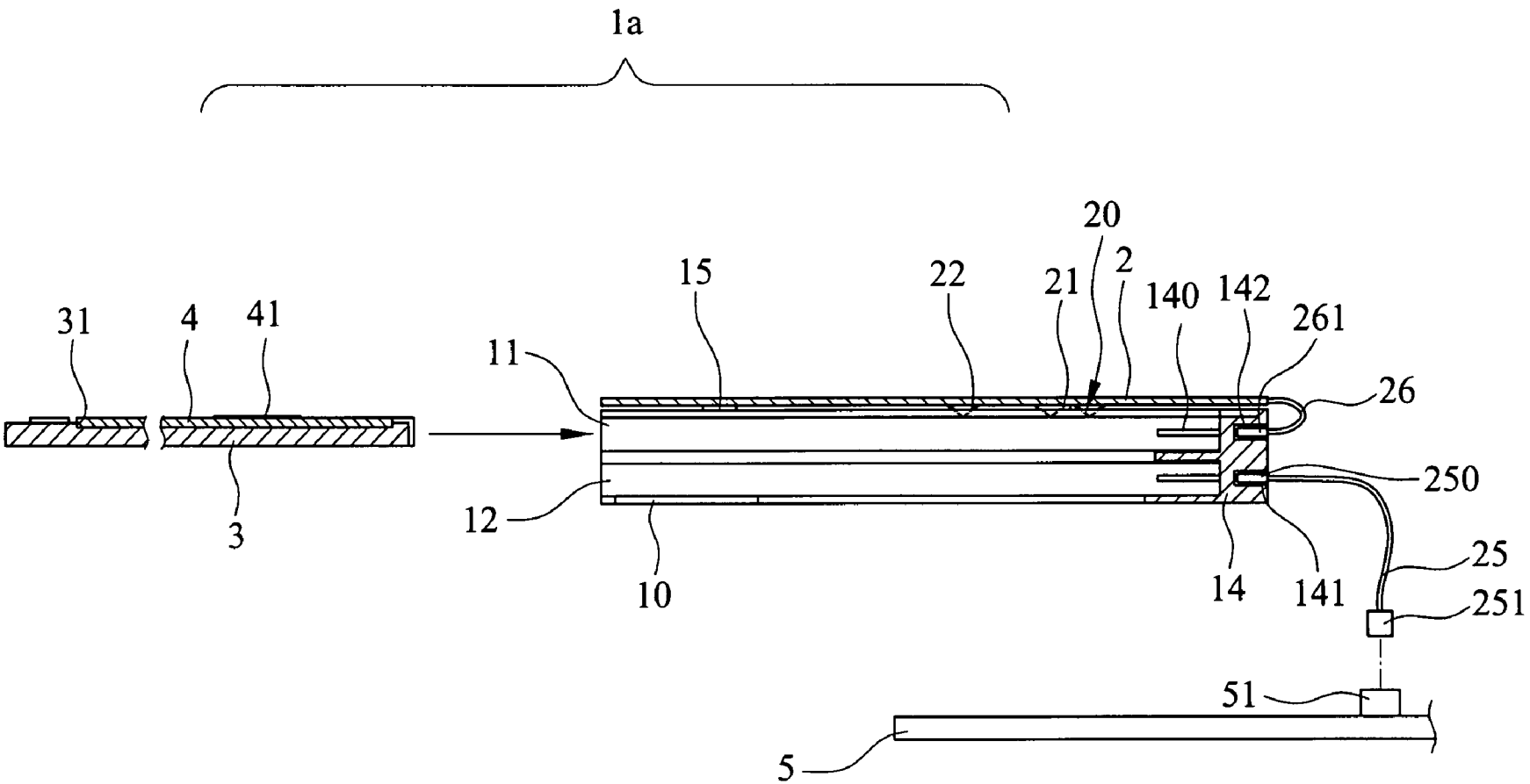
FIG. 9 is a cross-sectional view illustrating an adaptor device constructed in accordance with a second embodiment of the present invention connected to a computer main board.

Referring to FIG. 9, which is a cross-sectional view illustrating an adaptor device constructed in accordance with a second embodiment of the present invention connected to a computer main board, the adaptor device of the second embodiment is substantially similar to the first embodiment and those components/members that constitute in part the adaptor device of the second embodiment and that are similar to the counterparts of the adaptor device of the first embodiment will not be repeatedly described. A difference between the adaptor devices of the first and second embodiments is that the connection base 14 of the data card insertion structure 10 in accordance with the second embodiment forms a signal transfer port 142, whereby the cover board 2 is electrically connectable to the data card insertion structure 10 for output of a signal read by the signal contact elements 20 through the signal connection port 141 of the data card insertion structure 10.

The cover board 2 is connected to an interconnection cable 26 and an interconnection plug connector 261 of the interconnection cable 26 is plugged into the signal transfer port 142 of the data card insertion structure 10. The first plug connector 250 of the connection flat cable 25 is then connected to the signal connection port 141 of the data card insertion structure 10 and the second plug connector 251 of the connection flat cable 25 is connected to the socket connector 51 of the computer main board 5. When the cover board 2 that carries the chip card 4 is inserted into the data card insertion structure 10, the first signal contact elements 21 of the cover board 2 are set to correspond to and engage with the signal contact section 41 of the chip card 4, whereby the data of the chip card 4 can be supplied to the computer main board 5 of the computer device via the signal transfer port 142 of the data card insertion structure 10.

Figure 10:
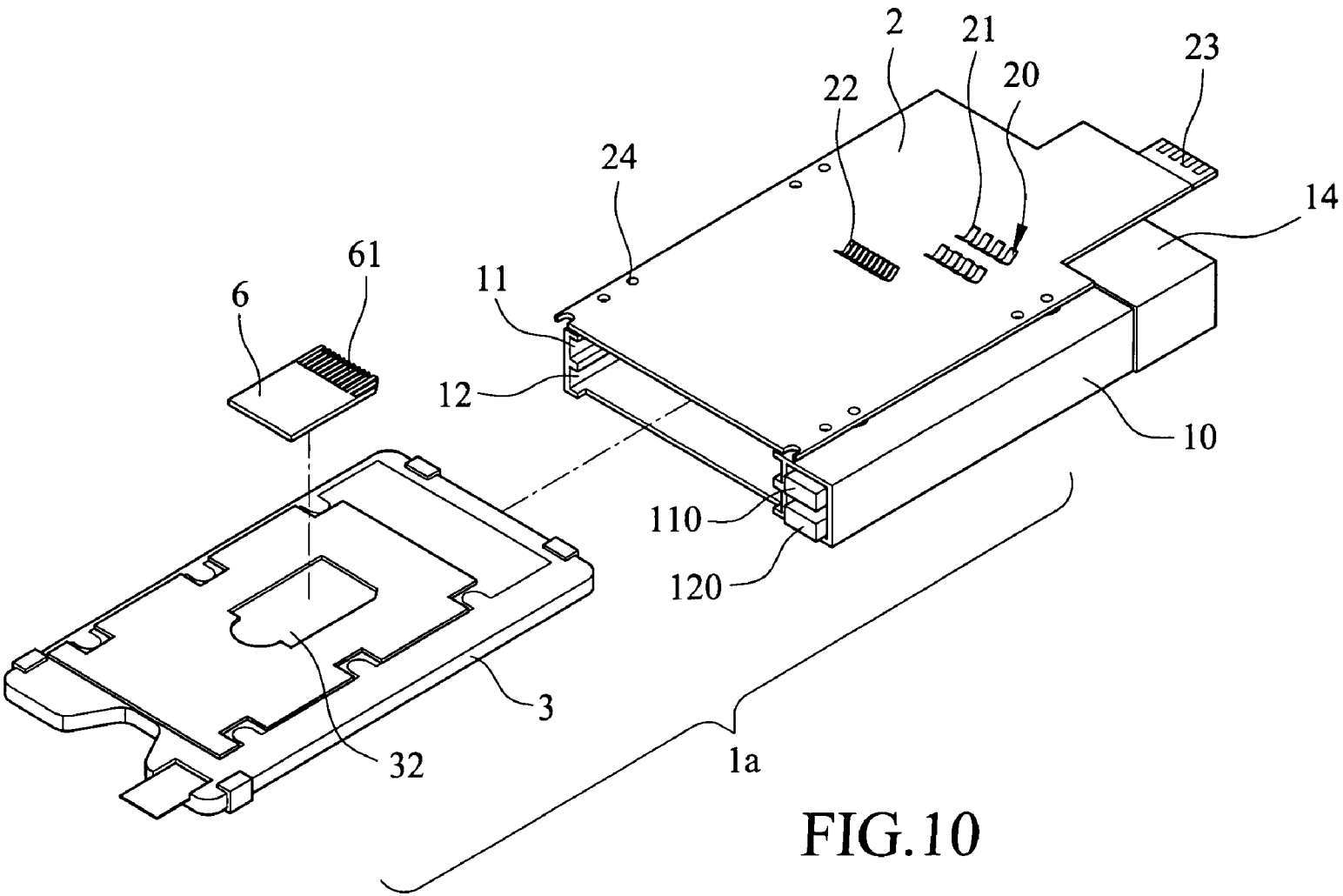
FIG. 10 is a perspective view illustrating an application of an adaptor device constructed in accordance with a third embodiment of the present invention to a memory card.
Figure 11:
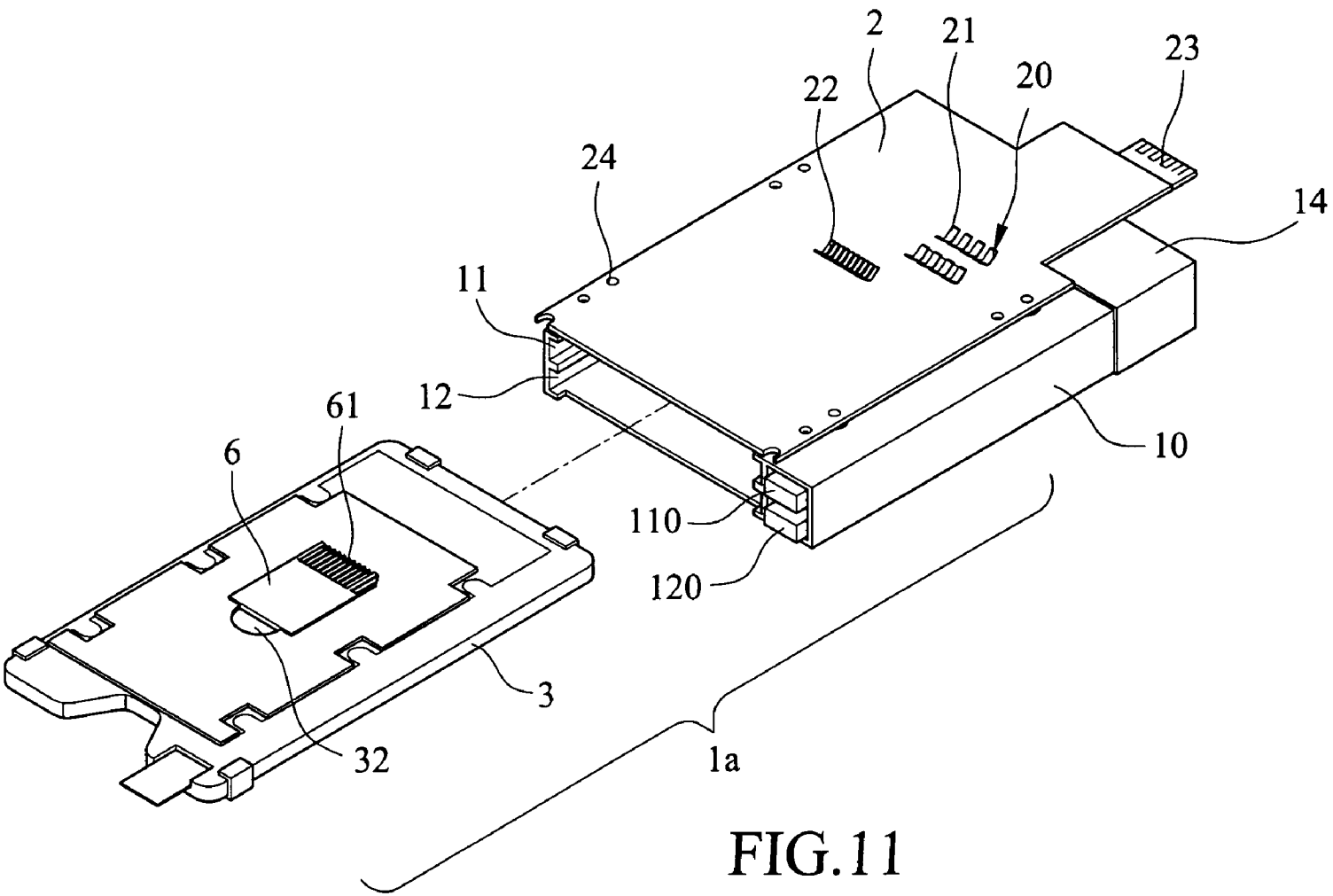
FIG. 11 is a perspective view demonstrating a memory card carried on a carrier board of the adaptor device of the third embodiment of the present invention.

FIGS. 10 and 11 are respectively a perspective view illustrating an application of an adaptor device in accordance with a third embodiment of the present invention to a memory card and a perspective view demonstrating the memory card carried on the carrier board, and in the instant embodiment, the components/members are similar to the counterparts thereof in the previously described embodiments so that repeated description is eliminated. A difference between the adaptor devices of the third embodiment and the previous embodiments is that the carrier board 3 forms a data card carrying section 32 that is of a configuration for receiving and carrying an SD memory card 6. (The SD memory card 6 is taken as an example for explanation and can be replaced or interchangeable with a CF memory card, an XD memory card, an MD memory card, an MS memory card, an SM memory card, or an MMC memory card, which are all known and available in the current market so that further description and definition of these memory cards are not necessary.) The SD memory card 6 has a signal terminal section 61. The SD memory card 6 is first positioned in the data card carrying section 32 in such a way that the signal terminal section 61 is exposed.

Figure 12:
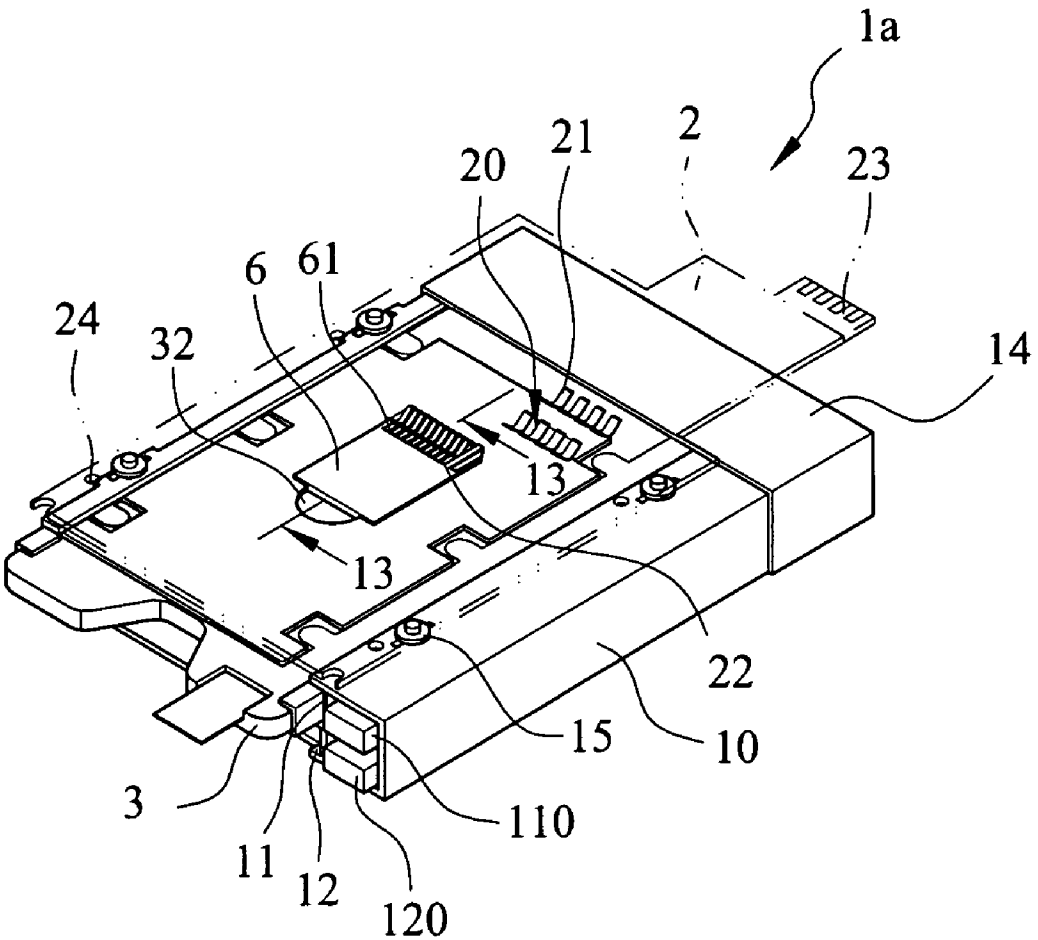
FIG. 12 is a perspective view illustrating the carrier board shown in FIG. 11 inserted into a data card insertion structure of the adaptor device of the present invention.
Figure 13:
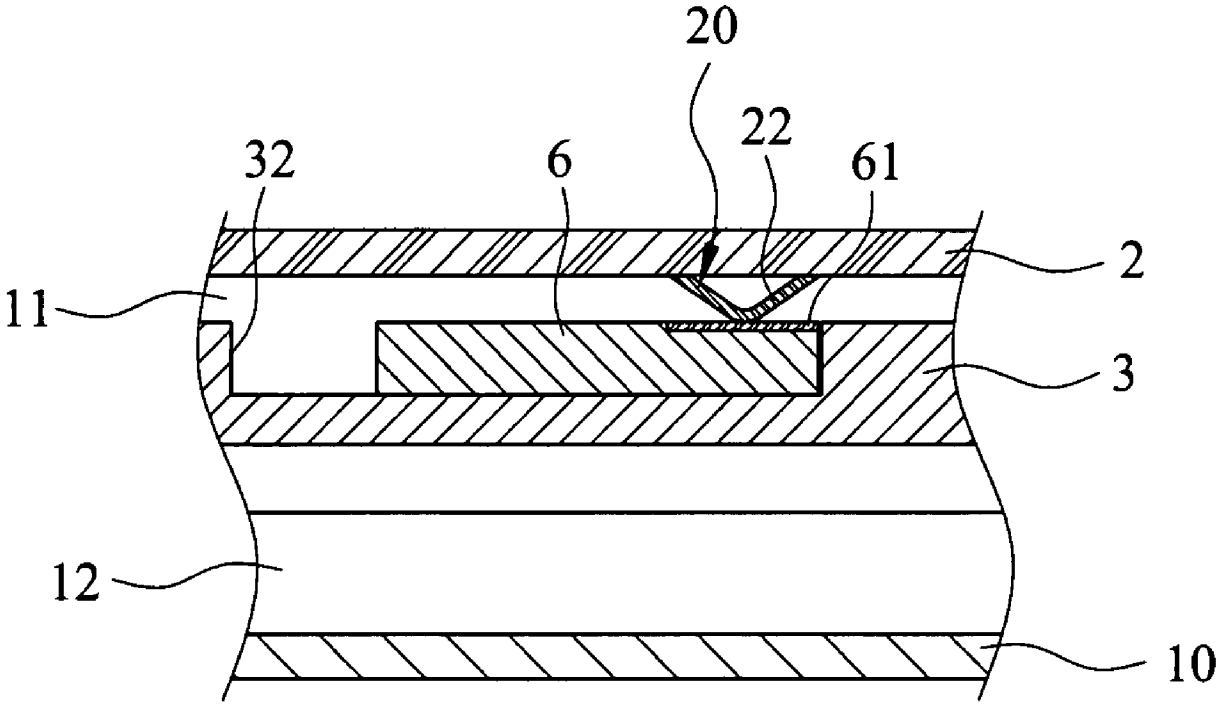
FIG. 13 is a cross-sectional view taken along line 13-13 of FIG. 12.

Referring to FIGS. 12 and 13, which are respectively a perspective view illustrating the carrier board shown in FIG. 11 inserted into the data card insertion structure and a cross-sectional view taken along line 13-13 of FIG. 12, the carrier board 3 that carries the SD memory card 6 is inserted into the first insertion slot 11 of the data card insertion structure 10. The signal terminal section 61 of the SD memory card 6 is thus set to engage the second signal contact elements 22 of the cover board 2 for reading data of the SD memory card 6. Signal transmission of the SD memory card 6 is similar to what described above and thus no repeated description is needed herein.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An adaptor device adapted to connect and access a data card, comprising:

a data card insertion structure forming at least one first insertion slot;

a cover board mounted on the first insertion slot, the cover board having at least one set of signal contact elements and a signal connection port, the signal contact elements being arranged at a predetermined position on the cover board, which position faces to the first insertion slot, the signal connection port being for output of a signal accessed by the signal contact elements; and a carrier board insertable into the first insertion slot of the data card insertion structure and having at least one data card carrying section corresponding to the signal contact elements of the cover board for carrying the data card thereon;

wherein when the data card is carried on the data card carrying section of the carrier board and is inserted into the first insertion slot of the data card insertion structure with the carrier board, a signal contact section of the data card is electrically connectable with the signal contact elements of the cover board.

2. The adaptor device as claimed in claim 1, wherein the data card insertion structure further comprises a second insertion slot.

3. The adaptor device as claimed in claim 1, wherein the data card comprises a chip card.

4. The adaptor device as claimed in claim 1, wherein the data card comprises a memory card selected from a group consisting of an SD memory card, a CF memory card, an XF memory card, an MD memory card, an MS memory card, an SM memory card, and an MMC memory card.

5. The adaptor device as claimed in claim 1, wherein the data card insertion structure further comprises a signal connection port.

6. An adaptor device adapted to connect and access a data card, comprising:

a data card insertion structure forming at least one first insertion slot and a signal connection port;

a cover board mounted on the first insertion slot, the cover board having at least one set of signal contact elements, which are arranged at a predetermined position on the cover board, which position faces to the first insertion slot, and is electrically connected to the signal connection port of the data card insertion structure for output of a signal read by the signal contact elements through the signal connection port of the data card insertion structure; and a carrier board insertable into the first insertion slot of the data card insertion structure and having at least one data card carrying section corresponding to the signal contact elements of the cover board for carrying the data card thereon;

wherein when the data card is carried on the data card carrying section of the carrier board and is inserted into the first insertion slot of the data card insertion structure with the carrier board, a signal contact section of the data card is electrically connectable with the signal contact elements of the cover board.

7. The adaptor device as claimed in claim 6, wherein the data card insertion structure further comprises a second insertion slot.

8. The adaptor device as claimed in claim 6, wherein the data card comprises a chip card.

9. The adaptor device as claimed in claim 6, wherein the data card comprises a memory card selected from a group consisting of an SD memory card, a CF memory card, an XF memory card, an MD memory card, and MS memory card, an SM memory card, and an MMC memory card.

10. The adaptor device as claimed in claim 6, wherein the data card insertion structure further comprises a signal transfer port for receiving the signal output from the signal contact elements of the cover board.

11. A computer device comprising an adaptor device adapted to allow the computer device to access data of a data card, the adaptor device comprising:

a data card insertion structure forming at least one first insertion slot in accordance with PCMCIA specification;

a cover board mounted on the first insertion slot, the cover board having at least one set of signal contact elements and a signal connection port, the signal contact elements being arranged at a predetermined position on the cover board, which position faces to the first insertion slot, the signal connection port being for output of a signal accessed by the signal contact elements; and a carrier board insertable into the first insertion slot of the data card insertion structure and having at least one data card carrying section corresponding to the signal contact elements of the cover board for carrying the data card thereon;

wherein when the data card is carried on the data card carrying section of the carrier board and is inserted into the first insertion slot of the data card insertion structure with the carrier board, a signal contact section of the data card is electrically connectable with the signal contact elements of the cover board.

12. The computer device as claimed in claim 11, wherein the data card insertion structure further comprises a second insertion slot.

13. The computer device as claimed in claim 11, wherein the data card comprises a chip card.

14. The computer device as claimed in claim 11, wherein the data card comprises a memory card selected from a group consisting of an SD memory card, a CF memory card, an XF memory card, an MD memory card, an MS memory card, an SM memory card, and an MMC memory card.

15. The adaptor device as claimed in claim 11, wherein the data card insertion structure further comprises a signal connection port.

* * * * *